US010213807B2

(12) United States Patent
Bruischat et al.

(10) Patent No.: US 10,213,807 B2
(45) **Date of Patent: *Feb. 26, 2019**

(54) COATING AND CURING DRYING SYSTEM

(71) Applicant: Atmosphere Control Solutions, LLC, Livonia, MI (US)

(72) Inventors: Daryl J. Bruischat, Holland, MI (US); Michael H. Bunnell, Plymouth, MI (US)

(73) Assignee: Atmosphere Control Solutions, LLC, Livonia, MI (US)

( * ) Notice: Subject to any disclaimer, the term of this patent is extended or adjusted under 35 U.S.C. 154(b) by 581 days.

This patent is subject to a terminal disclaimer.

(21) Appl. No.: 14/813,983

(22) Filed: Jul. 30, 2015

(65) Prior Publication Data

US 2017/0028435 A1 Feb. 2, 2017

(51) Int. Cl.

| | |
|---|---|
| ***F26B 19/00*** | (2006.01) |
| ***B05D 3/04*** | (2006.01) |
| ***F26B 21/00*** | (2006.01) |
| ***F26B 21/08*** | (2006.01) |
| ***B05C 15/00*** | (2006.01) |
| ***B05D 3/00*** | (2006.01) |
| ***B05D 7/14*** | (2006.01) |
| *F26B 15/12* | (2006.01) |

(52) U.S. Cl.

CPC ..... *B05D 3/0486* (2013.01); *B05C 15/00* (2013.01); *B05D 3/007* (2013.01); *B05D 7/14* (2013.01); *F26B 21/004* (2013.01); *F26B 21/08* (2013.01); *F26B 15/12* (2013.01); *F26B 2210/12* (2013.01)

(58) Field of Classification Search

CPC ..... F26B 25/06

USPC ..... 34/666, 201, 210, 215, 218, 474, 476, 34/477; 239/703, 548, 553, 566, 567, 239/568, 589, 589.1; 454/308

See application file for complete search history.

(56) References Cited

U.S. PATENT DOCUMENTS

| | | | | |
|---|---|---|---|---|
| 6,203,859 | B1 * | 3/2001 | Scheufler | B01D 46/12 34/475 |
| 2004/0033372 | A1 * | 2/2004 | Mueller | B05D 1/62 428/447 |
| 2012/0102780 | A1 * | 5/2012 | Bruischat | F26B 21/004 34/475 |
| 2013/0074362 | A1 * | 3/2013 | Lesicka | F26B 21/12 34/569 |

* cited by examiner

*Primary Examiner* — John McCormack

(74) *Attorney, Agent, or Firm* — The Weintraub Group, P.L.C.

(57) ABSTRACT

A drying system for drying a coating applied to an article of manufacture. The drying system includes an enclosable booth having an interior for housing the article of manufacture. The system also includes an air source for blowing air into the booth, means for raising the temperature of the air before entry into the booth, means for lowering the temperature of the air before entry into the booth, means for raising the humidity of the air before entry into the booth, and means for lowering the humidity of the air before entry into the booth. In one embodiment there is included at least one distribution cone which includes a conical member having a plurality of openings formed along the axis thereof. The cones emit air across an article of manufacture within the booth. During the drying process, both the temperature and the humidity within the booth is raised to accelerate drying.

8 Claims, 7 Drawing Sheets

COATING AND CURING DRYING SYSTEM

CROSS-REFERENCE TO RELATED APPLICATION

This application is related to the subject matter of co-pending U.S. patent application Ser. No. 13/283,501, filed Oct. 27, 2011, for a "Drying System," the entire disclosure of which is hereby incorporated by reference.

BACKGROUND OF THE INVENTION

1. Field of the Invention

The present invention concerns booths for drying and curing coating composition. More particularly, the present invention concerns such booths which introduce heated and/or cooled turbulent air to the interior of the booth to dry and cure articles therein. Even more particularly, the present invention pertains to such booths which introduce humid and/or dry turbulent air to the interior of the booth to dry and/or cure articles therein.

2. Description of the Prior Art

As is known to those skilled in the art to which the present invention pertains, many industries are being switched to water-based paints from solvent-based paints because of the volatile organic chemicals (VOCs) in the solvents. The elimination of VOCs for environmental purposes is well documented. However, the utilization of water-based paints creates issues ordinarily not encountered with solvent-based paints.

For example, since water evaporates much slower than solvents, water-based coating compositions dry at a much slower rate than coating compositions which are solvent-based in most any given environment. Because drying systems are expensive, quick drying cycles are vital for manufacturing processes in which articles of manufacture have been painted or coated with a composition.

In addition, there now also exists low-VOC aqueous coatings which are water activated. These types of coatings are known generally as "moisture cure" polyurethanes, or otherwise as Waterborne Chemical Agent Resistant Coatings (CARC). As understood, these coatings comprise a two-part composition, such as a urethane, which requires the presence of water in order to properly cure. To properly coat articles of manufacture with these coatings, water must first be removed to complete the drying process, and then again added in specific amounts to properly cure the coating.

These paints are advantageous because they have a low-VOC content, high durability, a long wet edge that eliminates dry spray, and an excellent film build which results in up to 30% less coating resulting in material savings. In addition, they have less odor, can be electrostatically applied, and can be non-flammable. Specific examples of these coatings include those sold under designation "MIL-DTL-64159 Type II-Waterborne" by Sherwin-Williams.

However, as discussed above, it is only feasible to use these paints if the drying cycles can be reduced to acceptable durations. Although traditional paint-drying booths are adept at circulating heated air within the booth to dry the paint, the booths known in the prior art cannot create the proper environment by reintroducing water into the booth as required by these water-activated paints.

As confirmed in laboratory testing performed by the Iowa Waste Production Center in April 2005, Waterborne CARC paints require at least 6½ hours to obtain a moderate level of dryness in favorable drying conditions. In order to obtain a "scratch resistant" level of dryness, these paints require over 24 hours in a favorable drying environment.

As will be described hereinbelow, the present invention provides a drying booth which can quickly alter the environment within the booth with respect to both the temperature and humidity to substantially reduce drying durations known in the prior art. Even more so, the present invention can properly dry and cure water-activated paints in a time which dramatically exceeds the capabilities of the prior art.

SUMMARY OF THE INVENTION

In a first embodiment hereof, there is provided a drying and curing system for drying a coating applied to an article of manufacture comprising: (a) an enclosable and sealable booth having an interior for housing the article of manufacture; (b) an air source for blowing air into the booth; (c) means for raising the temperature of the air before entry into the booth; (d) means for lowering the temperature of the air before entry into the booth; (e) means for raising the humidity of the air before entry into the booth; and (f) means for lowering the humidity of the air before entry into the booth.

In a second embodiment hereof, there is provided a method for drying a water-based coating applied to an article of manufacture comprising: (a) providing an enclosable and sealable booth which houses the article of manufacture, the booth including means for raising the temperature of the coating within the booth, means for lowering the temperature of the coating within the booth, means for raising the humidity within the booth, and means for lowering the humidity within the booth; (b) raising the temperature of the coating and lowering the humidity within the booth until the coating is dry; and (c) raising the humidity within the booth until the coating is cured.

Optionally, the embodiments above can include a plurality of air ducts for placing each of the following components in fluid communication with each other: (a) the interior of the booth; (b) the air source; (c) the means for raising the temperature of the air before entry into the booth; (d) the means for lowering the temperature of the air before entry into the booth; (e) the means for raising the humidity of the air before entry into the booth; and (f) the means for lowering the humidity of the air before entry into the booth.

Optionally, the means for raising the temperature of the air in the embodiments above can include at least one heating element positioned within the flow of air before the air enters the booth.

Optionally, the means for lowering the temperature of the air in the embodiments above can include at least one cooling coil positioned within the flow of air before the air enters the booth.

Optionally, the means for raising the humidity of the air in the embodiments above can include injecting steam into the flow of air before the air enters the booth.

Optionally, the means for raising the humidity of the air in the embodiments above can include injecting atomized water into the flow of air before the air enters the booth.

Optionally, the means for lowering the humidity of the air in the embodiments above can include at least one cooling coil positioned within the flow of air before the air enters the booth.

Optionally, the means for lowering the humidity of the air in the embodiments above can include passing the cooled air through a desiccant.

In a third embodiment hereof, there is provided a drying and curing system for drying a coating applied to an article of manufacture comprising: (a) an enclosable and sealable booth having an interior for housing the article of manufacture; (b) an air source for blowing air; and (c) a supply duct for delivering the air from the air source to (d) at least one air distribution cone positioned within the booth. Each provided distribution cone comprises a hollow substantially conical member having an open substantially circular air inlet, an opposed end, and an axis extending from the air inlet to the opposed end. Each air distribution cone also includes at least one plurality of linearly-disposed openings generally extending along a side of the cone from the air inlet toward the opposed end. The cone further includes means for rotatingly oscillating the cone about its axis. The distribution cones include a plurality of vanes and means for oscillating the cone. The vanes and the means for oscillating are operably connected to each other via a central shaft, wherein the plurality of vanes are positioned within the flow of air entering the cone and the flowing air rotates the vanes about the central shaft causing the shaft to rotate, and the means for oscillating then rotationally oscillates the cones using the rotational motion supplied by the central shaft.

In use, air is blown from the air source, through the supply duct, into each provided distribution cone via the air inlet, and out of each provided distribution cone via the linearly-disposed openings while the cone is rotatingly oscillating about its axis to provide a stream of air blown from side to side across the article of manufacture.

For a more complete understanding of the present invention, reference is made to the following detailed description and accompanying drawings. In the drawings, like reference characters refer to like parts throughout the several views in which:

DESCRIPTION OF THE PREFERRED EMBODIMENTS

Figure 1:
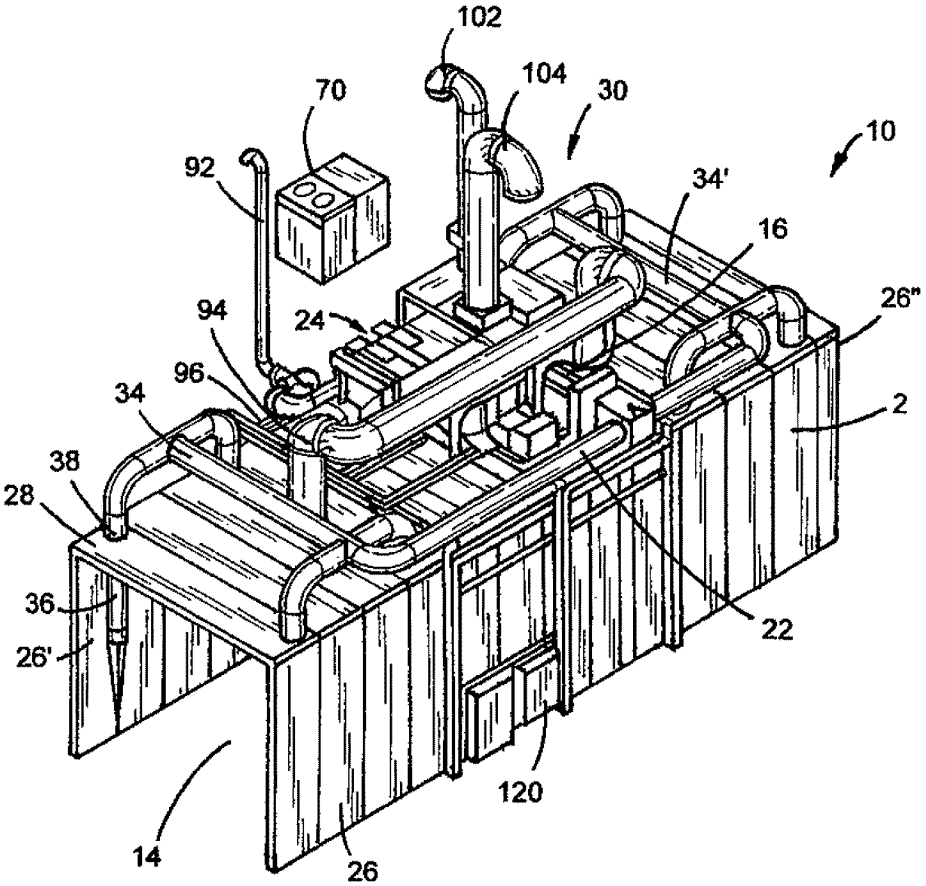
FIG. 1 is a perspective view of the front side and top of a drying and curing system in accordance with the present invention, the view showing a wall of the booth removed show a distribution cone positioned therein and to allow ingress and egress.
Figure 2:
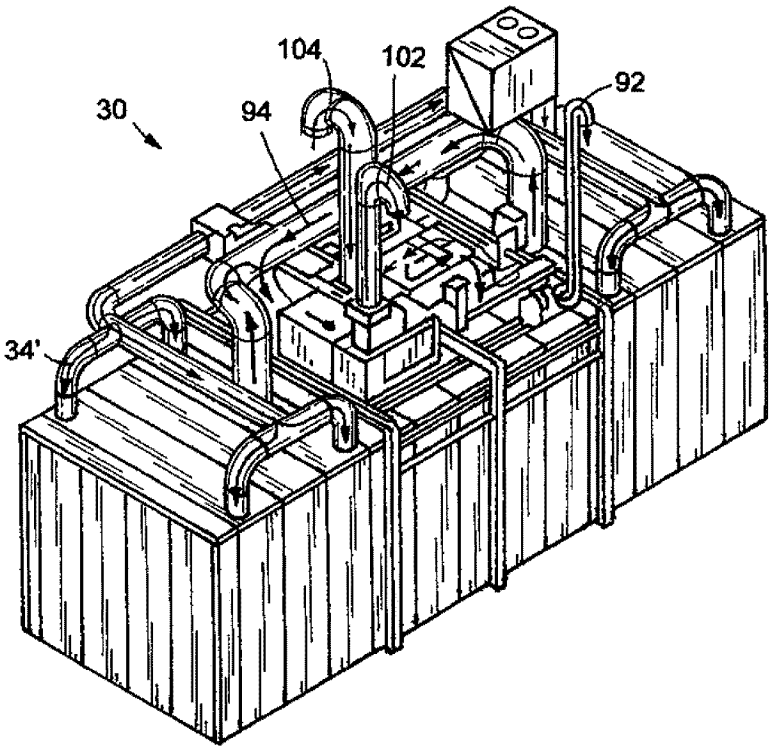
FIG. 2 is a perspective view of the rear side and top of a drying system in accordance with the present invention.
Figure 3:
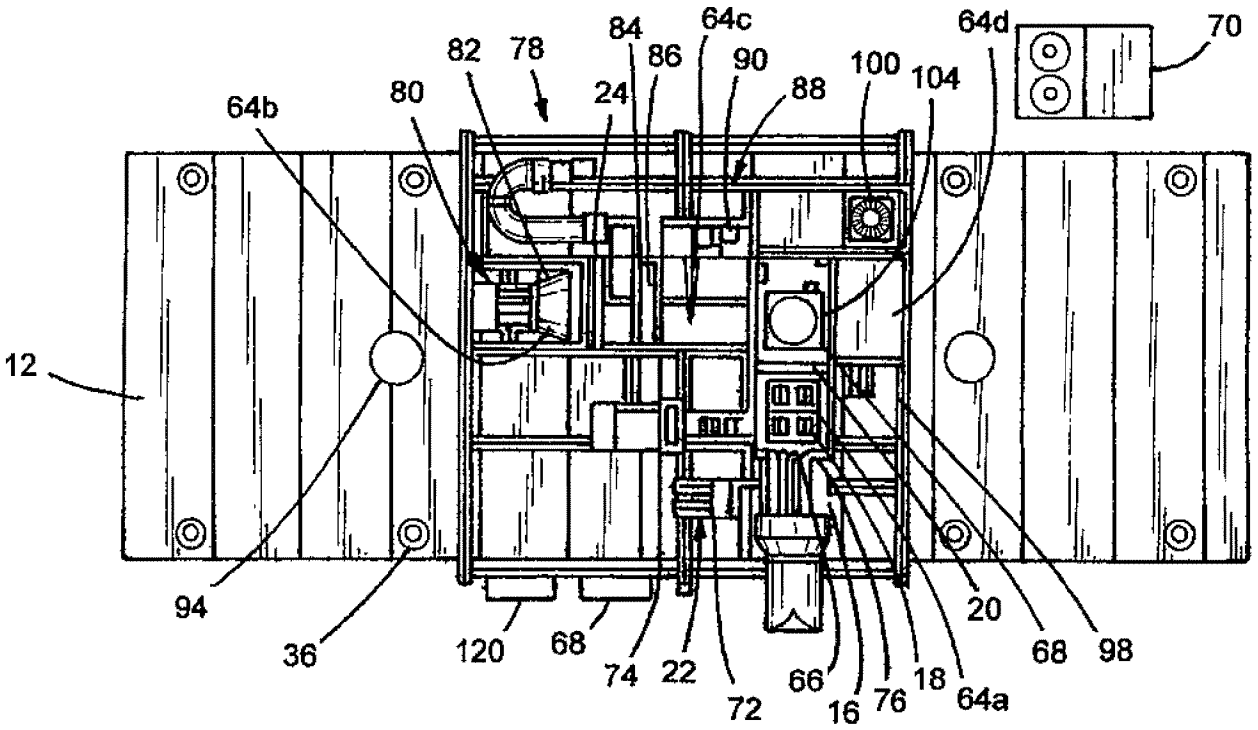
FIG. 3 is a top view of the in accordance with the present invention.

At the onset, it is noted that the drying and curing systems and method described hereinbelow can be used to dry and cure any suitable type of coating composition, including those which are solvent-based, aqueous-based, "moisture cure" polyurethanes (or Waterborne CARC paints), or the like. It is intended that the present invention has particular utility for use with "moisture cure" polyurethanes because the drying systems and method described herein can achieve the proper drying and curing conditions to quickly dry and cure these compositions.

As shown generally in FIGS. 1-3 and 5-7, and according to the first embodiment hereof, there is provided a drying system 10 for drying a coating applied to an article of manufacture (not shown) comprising: (a) an enclosable and sealable booth 12 having an interior 14 for housing the article of manufacture; (b) an air source 16 for blowing air into the booth 12; (c) means 18 for raising the temperature of the air before entry into the booth 12; (d) means 20 for lowering the temperature of the air before entry into the booth 12; (e) means 22 for raising the humidity of the air before entry into the booth 12; and (f) means for lowering the humidity 24 of the air before entry into the booth 12.

The system further includes means 25 for raising the temperature in the booth and means 27 for raising the humidity in the booth.

The drying system 10 comprises the enclosable booth 12 which can include a plurality of vertical walls 26,26',26", etc. and a ceiling 28. At least one of the walls 26 is movable to allow for ingress and egress of the article of manufacture. The booth 12 includes the interior 14 for housing the article of manufacture during the drying process.

Suitable sealing gaskets 29 are emplaced about the egress and ingress of the booth to seal it during use with VOC-containing coatings. The booth is sealed against the environment during application of a VOC-containing coating.

As shown generally throughout the drawings, an air treatment and circulation system 30 is positioned atop the booth 12. Although the air treatment and circulation system 30 is shown atop the booth 12 in the drawings, it is understood that the system 30 can be positioned in any other suitable location.

The air treatment and circulation system 30 includes the air source or supply blower 16, for blowing air into the booth 12. The supply blower 16 (as well as any other blowers which are provided hereinbelow) comprises any suitable type of fan, blower, or the like for use with ductwork to generate air movement therethrough.

The supply blower 16 forces the air into and through a plurality of supply ducts 34,34', etc. for delivering turbulent air into the booth 12 at various locations. Preferably, the supply ducts 34,34', etc. deliver the air into the booth 12 at locations proximal to the walls 26,26', etc. thereby enveloping the centrally-located article of manufacture within the interior 14.

Figure 8:
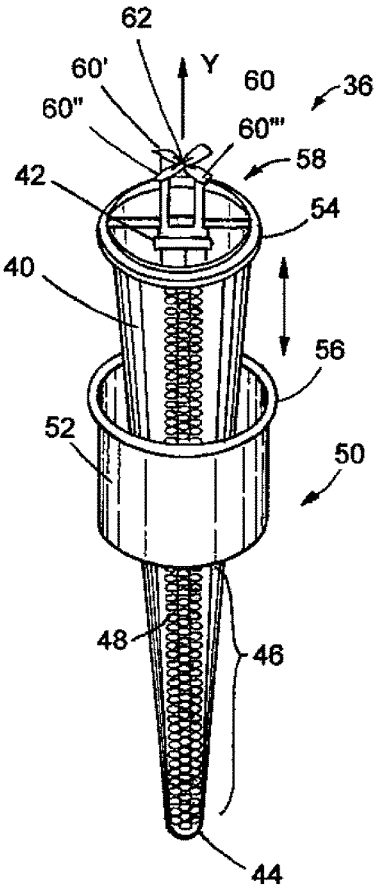
FIG. 8 is a partially exploded perspective view of a distribution cone in accordance with the present invention showing the distribution cone and the cone holder being positioned apart from each other.
Figure 9:
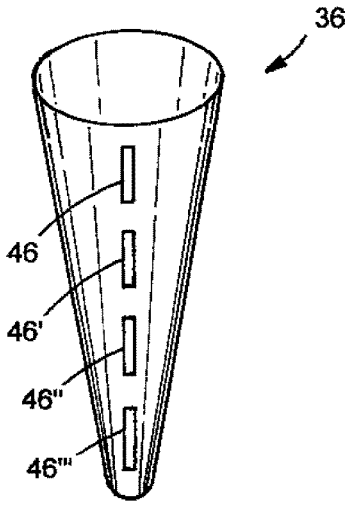
FIG. 9 is a perspective view of a distribution cone showing an alternative arrangement of the openings for releasing air.

A plurality of air distribution cones 36,36', etc. extend into the booth 12. Each distribution cone 36 is connected to an end 38 of a respective or associated supply duct 34. As shown in FIG. 8, each air distribution cone 36 preferably comprises a hollow substantially conical member 40 having an open substantially circular air inlet 42, an opposed end 44, and an axis y extending from the air inlet 42 to the opposed end 44. Each air distribution cone 36 includes at least one plurality of linearly-disposed openings 46,46', etc.

generally extending along a side of the cone 36 from the air inlet 42 toward the opposed end 44.

The openings 46,46', etc. can comprise a plurality of rectangular slats, holes, or any other suitably shaped openings 46,46', etc. which are arranged in an organized manner for distributing the air into the booth 12 in a manner which is desirable to one having ordinary skill in the art.

As shown in FIG. 8, each cone 36 can optionally include a plurality of louvers or cowls 48 which overlie the openings 46,46', etc. to direct and turbulate the air issuing out of the openings 46,46', etc. into the interior 14 of the booth 12.

Further, each cone 36 can include one or more plurality of linearly-disposed openings 46,46', etc. For instance, three or more plurality of openings 46,46', etc. can be provided.

As shown in the partially exploded FIG. 8, a cone holder 50 is used to rotatably secure each distribution cone 36 to the end 38 of the associated supply duct 34. Each cone holder 50 comprises an open-ended annular member 52 through which the associated cone 36 projects. Each cone holder 50 is secured to the end 38 of the supply duct 34. As shown, the air inlet 42 of the cone 36 has an annular or peripheral rim 54 which sits atop a rim 56 on the cone holder 50.

Each distribution cone 36 also includes means for oscillating 58 the cone 36 about the axis y. Preferably, each cone 36 includes a plurality of vanes 60,60', etc. and means for oscillating 58 the cone 36. The vanes 60,60', etc. and the means for oscillating 58 are operably connected to each other via a central shaft 62. The plurality of vanes 60,60', etc. are preferably positioned within the flow of air entering the cone 36 so that the flowing air rotates the vanes 60,60', etc. about the central shaft 62 and causes the shaft 62 to rotate. The rotating shaft 62, in turn, provides rotational movement to the means for oscillating 58.

The means for oscillating 58 comprises any suitable mechanical linkage, gearing, or other well-known structure for translating the rotational kinetic energy of the shaft 62 into rotational oscillating movement. For purposes of clarity, and as understood by one having ordinary skill in the art, "rotational oscillating movement" is intended to refer to rotational pivoting movement back and forth along an arc about the distribution cone's axis y. The means for oscillating 58 can be configured to oscillate each cone 36 to any desired amount. For example, cones located near a corner within the booth 12 could rotate 90°, while other cones located along a wall could rotate 180°.

These degrees of rotation are not intended to be limiting, but are only provided by way of example and for explanatory purposes. The cones 36,36', etc. may be configured to simply rotate a full 360° rather than configured to rotatingly oscillate. It is intended that one having ordinary skill in the art can position the supply ducts 34,34', etc. and distribution cones 36,36', etc. anywhere throughout the booth 12 as desired. Likewise, the degree of rotation for each cone 36 can be customized as deemed optimal by one having ordinary skill in the art.

It is understood that the distribution cones 36,36', etc. can be positioned and configured as necessary to provide sufficient air flow over the article of manufacture in order to accelerate the drying cycle. Optimizing the performance of the distribution cones 36,36', etc. is considered to be within the capabilities of one having ordinary skill in the art.

Providing additional airflow to articles of manufacture may be adequate for those which have been coated with a solvent-based composition, or even an aqueous-based composition. However, it is known that simply providing additional airflow has minimal benefit to articles of manufacture which have been coated with a "moisture cure" polyurethane, or a waterborne CARC paint. For articles of manufacture which have been coated with these compositions, it is also necessary to closely control both the level of heat and humidity within the booth 12 to create the proper drying and curing environment. Even more so, rapidly adjusting the environment in the interior 14 from one condition to the next is crucial to reducing the duration of the drying cycle.

Accordingly, there is provided: (1) the means for raising the temperature 18 of the air; (2) the means for lowering the temperature 20 of the air; (3) the means for raising the humidity 22 of the air; and (4) the means for lowering the humidity 24 of the air before entry into the booth 12.

In order to direct the airflow from one component in the invention to the next, there is provided a plurality of air ducts 64*a*,64*b*, etc. for placing the various components in fluid communication with each other. Each air duct 64*a*,64*b*, etc. is of the type which is known to one having ordinary skill in the art. Preferably, each air duct 64*a*,64*b*, etc. is generally rectangular in cross-section and has walls formed from sheet metal.

The means for raising the temperature 18 of the air is positioned within the air duct 64*a* upstream from the supply blower 16. Any suitable source of heat can be used herewith and is preferably introduced to the air before passing through the supply blower 16 and into the supply ducts 34,34', etc. For example, heated liquid-filled coils or heated combustion byproducts can be used to heat the air. Preferably, at least one electric-powered heating element 66 is located in the air duct 64*a* and positioned within the flow of air to increase the temperature of the air passing thereby.

Likewise, the means for lowering the temperature 20 of the air before entry into the booth 12 can comprise any suitable device for reducing the temperature. Preferably, the means for lowering the temperature 20 comprises a cooling coil 68 which is located within the air duct 64*a* upstream of the supply blower 16 and positioned in the flow of air to decrease the temperature of the air passing thereby. As understood by one having ordinary skill in the art, the cooling coil 68 is filled with a coolant or refrigerant which is cooled by a compressor condensing unit 70. The compressor condensing unit 70 can be positioned near the cooling coil 68, or it can be positioned at a remote location, such as outside the building not shown) which houses the drying system 10. The operation of a compressor condensing unit is well understood by one having ordinary skill in the art, thus further discussion regarding its operation has not been provided.

Because it is only sensible that the means for raising the temperature 18 and the means for lowering the temperature 20 would not be operated at the same time, they can be positioned relatively proximal to each other within the air duct 64*a* upstream of the supply blower 16.

The means for raising the humidity 22 of the air before entering the booth 12 can comprise a steam generator 72 which is connected to the air duct 64*a* via suitable hosing 74 in order to inject steam into the air duct 64*a*. It is apparent that steam will introduce both heat and water vapor to the air, thereby increasing the humidity, and also to some degree, the temperature.

In addition to the steam generator 72, the means for raising the humidity 22 can include at least one atomizer 76 connected to a water source for injecting or spraying, atomized water (or mist) into the air duct. It is apparent that the atomized water will increase the humidity of the air. The means for raising the humidity 22 can include any other suitable type of device which is well-known to one having ordinary skill in the art.

It is to be understood that the drying system 10 can operate with either, or both, the steam generator 72 and the at least one atomizer 76. One having ordinary skill in the art will appreciate that the steam generator 72 and the at least one atomizer 76 have differing performance characteristics and the use of either or both of these devices will be determined by one having ordinary skill in the art as a matter of optimizing performance of the drying system 10. Preferably, the means for raising the humidity 22 of the air is positioned in the air duct 64*a* at a location upstream of the air source 16 and relatively proximal to both the means for lowering 20 and raising 22 the temperature of the air.

In addition, the drying system 10 includes the means for lowering the humidity 24 of the air. Although any suitable type of dehumidification system which is suitable herewith can be used, this embodiment of the invention includes a dehumidification system 78 as shown best in FIGS. 3 and 4. The dehumidification system 78 includes a dryer blower 80, a pre-cooling coil 82, and optionally, a desiccant 84. The dryer blower 80 blows ambient air through an air duct 64*b* and past the pre-cooling coil 82. As the ambient air drops in temperature across the pre-cooling coil 82, the dew point of the air is approached and a volume of the water in the air condensates and drops out of the air. To further reduce the humidity of the air, the air can then pass through the desiccant 84.

The desiccant 84 can be any type of desiccant which is well-known and suitable for use herewith. Preferably the desiccant 84 is a desiccant wheel 86 such that a reactivation system 88 can be used to "recharge" the desiccant 84, such as described further below. After the air is pre-cooled and optionally passed through a first side of the desiccant wheel 86, it can then pass through the air duct 64*c* into the air duct 64*a* upstream of the supply blower 16.

It is thus shown that this embodiment of the invention provides means for raising the temperature 18, lowering the temperature 20, raising the humidity 22, and lowering the humidity 24 of the air before the air passes through the supply ducts 34,34', etc. and distribution cones 36,36', etc. and into the booth 12.

As mentioned above, optionally there can be provided a reactivation system 88. A portion of the air which has passed through the first side of the desiccant wheel 86 can be routed toward at least one reactivation heater 90 and then back through a second side of the desiccant wheel 86. In one example, about 25% of the air passing through the dehumidification system 78 is routed to the reactivation system 88. As understood by one having ordinary skill in the art, the air heated by the reactivation heater 90 draws moisture off of the desiccant wheel 86 to "recharge" the desiccant wheel 86. The heated air is then sent through a reactivation exhaust duct 92 to exit the drying system 10.

According to this embodiment, there is also provided an air return system 94 which includes at least one return duct 96 which is connected to the interior 14 of the booth 12. A return blower 98 can be provided to assist with pulling the air out of the booth 12. The return blower 98 can also be used to help with purging the air out of the drying system 10. The return blower 98 blows the air into air duct 64*d* which passes by an exhaust blower 100. The exhaust blower 100 and exhaust duct 102 can purge air from the drying system 10 when deemed necessary as part of the drying process. The exhaust blower 100 and exhaust duct 102 also can be used as a release to evacuate VOCs or other contaminants from the air. It is known that aqueous-based coatings are susceptible to foreign contaminants, and, therefore, it is important to provide a mechanism for maintaining an adequate level of these contaminants within the drying system 10.

The air then passes by a makeup air duct 104. The makeup air duct 104 can function as an air intake for the drying system 10, but it also can be used to introduce equal volumes of fresh air which have been evacuated by the exhaust blower 100 and exhaust duct 102. The makeup air duct 104 can include an air filter (not shown) for ensuring that only clean filtered air enters into the air treatment and circulation system 30. After passing by the makeup air duct 104, the air is then, once again, upstream of the supply blower 16 and ready to be heated, cooled, or humidified before recirculating through the drying system 10.

It is noted that the dehumidified air has its own dehumidification system 78 which handles only fresh air. Thus, recirculated air is not passed through the dehumidification system 78. However, water vapor will condensate out of any recirculated air which is cooled to a sufficient point that the dew point has been reached. Therefore the resulting recirculated air can then still be dehumidified to some degree even without passing through the dehumidification system 78.

Optionally, there is also provided an injection air blower 108 and injection air heater bank 110 for providing an injection of heated air into the drying system 10 when necessary. The injection air blower 108 and injection air heater bank 110 can be used to provide a boost of heated air to the air treatment and circulation system 30 whenever it is considered beneficial by one having ordinary skill in the art. For instance, if a substantial portion of heated air is being exhausted through the exhaust blower 100 and exhaust duct 102, it may be necessary to reintroduce fresh heated air through the injection air blower 108 and injection air heater bank 110 to maintain the desired conditions within the booth 12. Additionally, the injection air blower 108 and injection air heater bank 110 can be used in conjunction with the at least one atomizer 76 to produce heated humid air.

Figure 4:
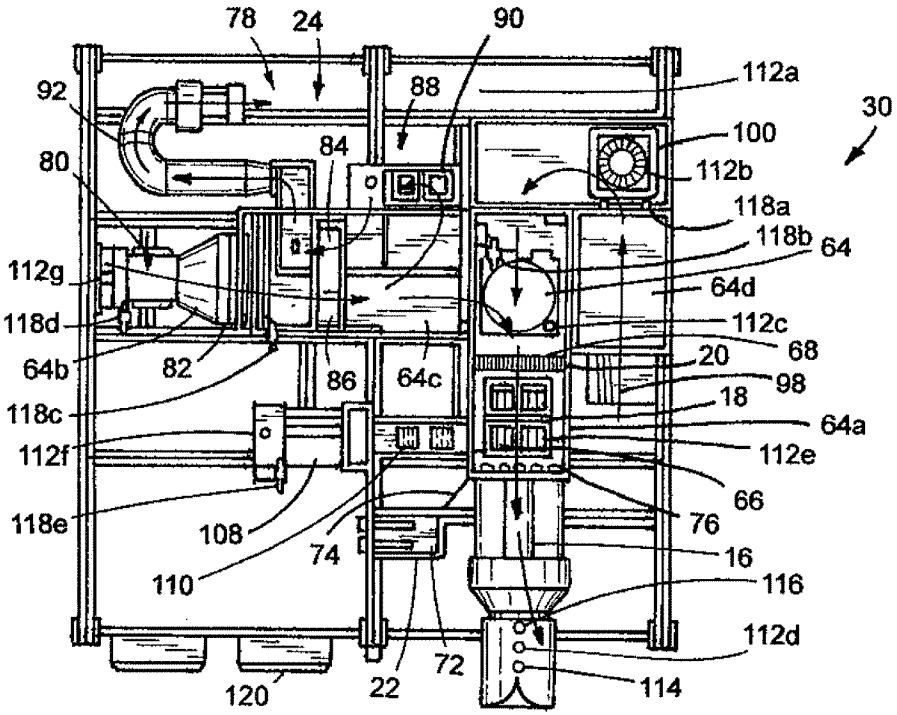
FIG. 4 is a top view of the air treatment and circulation system, including arrows indicating air flow through the system and the designated locations of various sensors and pressure transducers.
Figure 7:
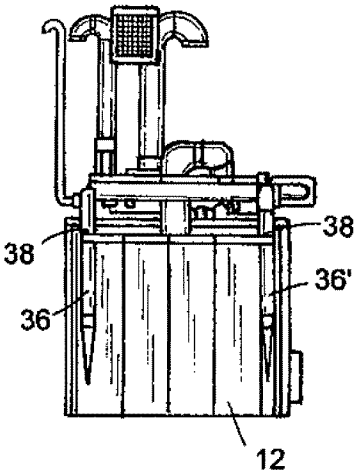
FIG. 7 is a side view of the drying system in accordance with the present invention, the view showing the near end of the booth having a wall removed.
Figure 5:
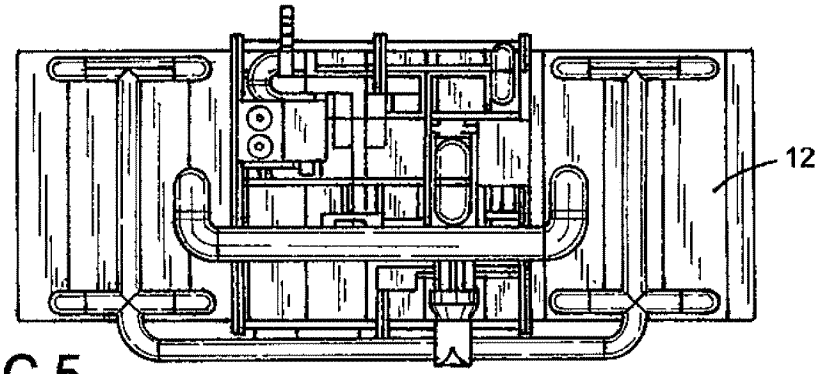
FIG. 5 is a top view of the drying system in accordance with the present invention.
Figure 6:
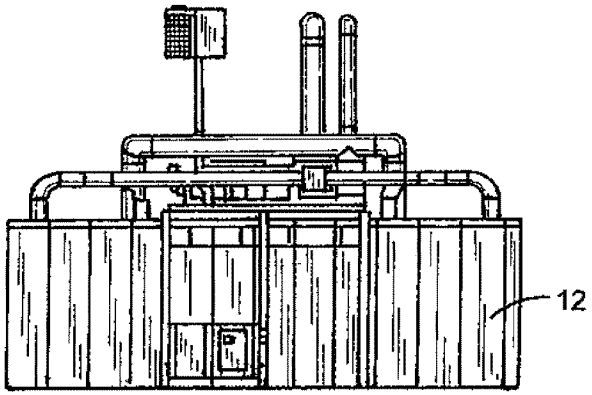
FIG. 6 is a front view of the drying system in accordance with the present invention.

To assist in understanding the flow of air throughout the air treatment and circulation system 30, FIG. 4 includes directional arrows which indicate the direction of air flow throughout the system.

In order to properly monitor and direct the air flow throughout the drying system 10 as necessary to create the desired conditions within the interior 14 of the booth 12 at the desired time, there is also provided a plurality of temperature sensors 112*a*,112*b*, etc., at least one humidity sensor 114, at least one velocity sensor 116, and a plurality of pressure transducers 118*a*,118*b*, etc. throughout the drying system 10. Positioning of these various components throughout the drying system 10 can be determined by one having ordinary skill in the art. However, by way of example, each of the temperature sensors 112*a*,112*b*, etc., humidity sensor 114, velocity sensor 116, and pressure transducers 118*a*,118*b*, etc. can be positioned as indicated in FIG. 4.

In addition, a plurality of louvers, or baffles (not shown), are positioned within the air ducts 64*a*,64*b*, etc. at various positions throughout the drying system 10 in order to direct proper air flow through the proper air ducts 64*a*,64*b*, etc. to route the air as required. Although the louvers are not shown, the exemplary positioning of each louver is indicated by the presence of a pressure transducer 118*a*,118*b*, etc. in FIG. 4. As understood by one having ordinary skill in the art, pressure transducers can be used to monitor the flow of air, and thus the amount of air flow passing by the louver. The louvers are motorized so that they can be centrally controlled and operated.

Also included is an electronic control system 120 which monitors and controls the air treatment and circulation system 30. The electronic control system 120 is electrically connected to each of the blowers, heaters, louvers, temperature sensors, velocity sensors, louver motors, pressure transducers, the steam generator 72, the atomizer 76, the compressor condensing unit 70, and so forth. The electronic control system 120 can be programmed to create specific conditions within the interior 14 of the booth 12 to dry and cure the coated article of manufacture as quickly as possible.

The following is an example of how the drying system 10 can be used for drying an article of manufacture which is coated with a waterborne CARC paint. First the article of manufacture is placed within the interior 14, and the booth 12 is sealed shut. A user loads a program or enters the appropriate settings into the electronic control system 120 and then begins the drying cycle. The exhaust blower 100, injection air blower 108, and compressor condensing unit 70 are all turned off, and the appropriate louvers are closed so that no air can enter via the injection air blower 108 or the exhaust blower 100. The supply blower 16 and dryer blower 80 are turned on and the means for raising the temperature 18 of the air is activated, thereby supplying the interior 14 of the booth 12 with heated dry air for drying the aqueous coating.

If the level of VOCs or other contaminants within the interior 14 reaches an unacceptable level, the exhaust blower 100 will turn on, and the exhaust louver and the makeup air intake louver will open at least partially to allow a specified volume of contaminated air out of the exhaust duct 102 and a corresponding volume of fresh air in through the makeup duct. It is an objective of the drying system 10 to recirculate as much air as possible, therefore, the exhaust blower 100 will turn off and the exhaust louver and makeup air intake louver will close when conditions within the booth 12 are once again acceptable.

After a predetermined amount of time lapses, the dryer blower 80 turns off, the dryer blower louver closes, and the means for raising the humidity 22 is turned on, thereby introducing hot humid air into the booth 12 to properly cure the coating.

After a predetermined amount of time has again lapsed, the means for raising the humidity 22 is turned off, the exhaust blower 100 is turned on, the exhaust fan louver is at least partially opened, the means for raising the temperature 18 is turned off, and the means for lowering the temperature 20 is turned on. The dehumidification system 78 may be turned on again as well. Thus, the hot humid air is evacuated from the booth 12 and cool dry air is introduced in order to lower the surface temperature of the article of manufacture so that it can be handled by the user.

It is to be understood that the preceding example of operation is for explanatory purposes only, and it is expressly not intended to be limiting in any manner.

In operation, the air circulates through the entire drying system 10 about once per minute. As is now apparent, the humidity can range from 0% to 100% depending upon the deployment of the means for raising or lowering the humidity. Similarly, the temperature within the booth 12 can exceed temperatures of 150° F. when the means for raising the temperature 18 are activated.

The air ducts can also include proper drainage for draining condensed water which has collected on the bottom of the air ducts.

As discussed above, it has been determined that traditional drying booths require over 24 hours in order to properly dry and cure articles of manufacture which have been coated with the "moisture cure" polyurethanes or waterborne CARC paints. By way of experimentation, it has been determined that the present invention can properly dry, cure, and cool (allowing the articles to be handled by the user) these articles of manufacture in approximately 1½ hours or less, thereby establishing a significant improvement over the prior art.

Figure 10:
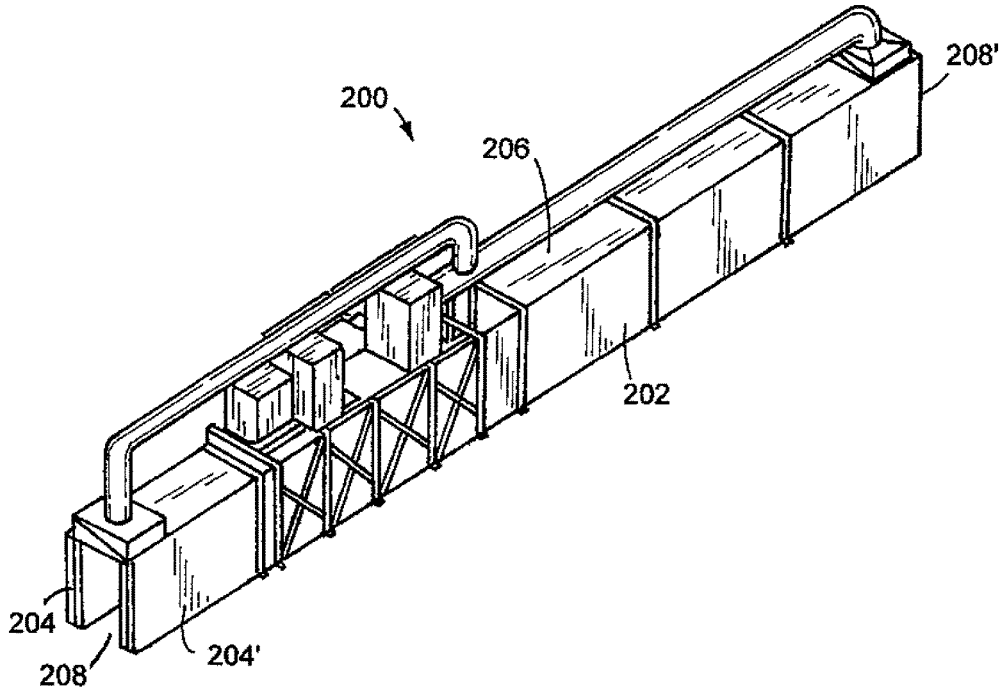
FIG. 10 is an alternative embodiment of the invention showing the air treatment and circulation system positioned atop a tunnel for passing the article of manufacture therethrough.

According to yet another embodiment, and as shown in FIG. 10, the drying system 200 includes an elongated tunnel 202 comprising a pair of spaced apart sidewalls 204,204', respectively, and a ceiling 206. The tunnel 202 has opposed open ends 208,208' to enable a car or similar article of manufacture to traverse the interior thereof.

In practicing the present invention, as noted above, the time for drying and curing an article of manufacture is accelerated by the practice hereof. Contrary to what would normally be expected it has been found that by raising the temperature and the humidity within the booth drying is accelerated. Typically, the temperature within the booth is raised to about 70° F. and the humidity is raised from about 30% to about 55% during the initial coating process.

Thereafter, the temperature in the booth is accelerated rapidly, for example, to about 90° F. within about five minutes to effectuate drying. Since this accelerated temperature rise would normally lower the humidity rapidly, it is at this point that atomized water and steam is added to the booth to raise the humidity during drying to about 15%. If a VOC-based coating is being applied to the article, the booth is open to the atmosphere during this process. When the VOCs drop below the minimum safety standard or are not present the booth is sealed.

After the coating is dried, it is then cured. If the article is metallic, curing is effected by raising the temperature of the metal, itself, to at least about 160° F. to about 180° F. The temperature is held thereat for about five minutes. The drying air is dried by passing it through a desiccant. This dried air is then admixed with a quantity of fresh air to maintain a lower humidity.

Where a water borne coating is used the booth is closed to the environment After the initial coating the air is exhausted.

Where VOC coatings are used or a sealed loop using recirculated air is in place during the coating as well as the drying and curing.

The present invention has been described generically with reference to coating "articles of manufacture." As used herein, "articles of manufacture" can refer to automobiles, military vehicles, wall panels, door panels such as garage door panels, appliances, coated aluminum panels for construction, or the like.

Although the drying system 10 has been described herein as a whole, it is also envisioned that the air treatment and circulation system 30 can be used to retrofit existing drying booths.

As is apparent from the preceding, the present invention provides a drying booth which can quickly alter the environment within the booth with respect to both the temperature and humidity to substantially reduce drying times over that which is known in the prior art. Even more so, the present invention can properly dry and cure water-activated paints in a time which dramatically exceeds the capabilities of the prior art.

What is claimed is:

1. A drying and curing system for drying and curing a water-based coating applied to an article of manufacture comprising:

(a) an enclosable and sealable booth having an interior for housing the article of manufacture;
(b) an external air source for blowing air into the booth;
(c) means for raising the temperature of the air before entry into the booth;
(d) means for lowering the temperature of the air before entry into the booth;
(e) means for raising the humidity of the air before entry into the booth;
(f) means for lowering the humidity of the air before entry into the booth;
(g) means for raising the temperature of the air within the booth;
(h) means for lowering the temperature of the air within the booth;
(i) means for lowering the temperature of the air to lower the temperature of the article;
(j) means for raising the temperature of the air and lowering the humidity in the booth until the coating is dry; and
(k) means for raising the humidity within the booth until the coating is cured.

2. The drying and curing system of claim 1 including a plurality of air ducts for placing the following in fluid communication with each other:
(a) the interior of the booth;
(b) the air source;
(c) the means for raising the temperature of the air before entry into the booth;
(d) the means for lowering the temperature of the air before entry into the booth;
(e) the means for raising the humidity of the air before entry into the booth; and
(f) the means for lowering the humidity of the air before entry into the booth.

3. The drying and curing system of claim 1 wherein the means for raising the temperature of the air before entry into the booth comprises at least one heating element positioned within the flow of air before the air enters the booth.

4. The drying and curing system of claim 1 wherein the means for lowering the temperature of the air comprises at least one cooling coil positioned within the flow of air before the air enters the booth.

5. The drying and curing system of claim 1 wherein the means for raising the humidity of the air before entry into the booth comprises: a source of steam, the source including means for injecting steam into the flow of air before the air enters the booth.

6. The drying and curing system of claim 1 wherein the means for raising the humidity of the air before entry into the booth comprises: a source of injecting atomized water, the source including means for injecting the atomized water into the flow of air before the air enters the booth.

7. The drying and curing system of claim 1 wherein the means for lowering the humidity of the air within the booth comprises: at least one cooling coil positioned within the flow of air before the air enters the booth.

8. The drying and curing system of claim 7 wherein the means for lowering the humidity of the air within the booth comprises: a desiccant, the air passing through the desiccant.

* * * * *